US008476972B2

(12) United States Patent
Wang et al.

(10) Patent No.: US 8,476,972 B2
(45) Date of Patent: Jul. 2, 2013

(54) METHOD AND APPARATUS FOR AMPLIFYING A TIME DIFFERENCE

(75) Inventors: You-Jen Wang, Taipei (TW); Shen-Iuan Liu, Taipei (TW); Feng Wei Kuo, Zhudong Township, Hsinchu County (TW); Chewn-Pu Jou, Hsinchu (TW); Fu-Lung Hsueh, Cranbury, NJ (US)

(73) Assignees: Taiwan Semiconductor Manufacturing Co., Ltd, Hsin-Chu (TW); National Taiwan University, Taipei (TW)

( * ) Notice: Subject to any disclaimer, the term of this patent is extended or adjusted under 35 U.S.C. 154(b) by 110 days.

(21) Appl. No.: 12/813,620

(22) Filed: Jun. 11, 2010

(65) Prior Publication Data

US 2011/0304372 A1 Dec. 15, 2011

(51) Int. Cl.
*G06G 7/12* (2006.01)
*G06G 7/26* (2006.01)

(52) U.S. Cl.
USPC ..... 327/563; 327/112; 327/295

(58) Field of Classification Search
USPC ..... 327/108, 112, 170, 295, 563
See application file for complete search history.

(56) References Cited

U.S. PATENT DOCUMENTS

| | | | | |
|---|---|---|---|---|
| 5,672,991 | A * | 9/1997 | Thoma et al. | 327/239 |
| 6,411,150 | B1 * | 6/2002 | Williams | 327/281 |
| 6,433,602 | B1 * | 8/2002 | Lall et al. | 327/205 |
| 6,580,302 | B2 * | 6/2003 | Shimoshige | 327/259 |
| 6,597,199 | B1 * | 7/2003 | Bui | 326/83 |
| 6,683,475 | B2 * | 1/2004 | Baker | 326/83 |
| 6,992,512 | B1 * | 1/2006 | D'Aquino et al. | 327/112 |
| 7,230,463 | B2 * | 6/2007 | Allen et al. | 327/112 |
| 7,477,086 | B1 * | 1/2009 | Maung | 327/333 |
| 7,495,497 | B1 * | 2/2009 | Fu | 327/427 |
| 7,633,329 | B2 * | 12/2009 | Park | 327/415 |
| 2007/0216464 | A1 * | 9/2007 | Roche et al. | 327/295 |
| 2009/0261878 | A1 | 10/2009 | Lin | |

OTHER PUBLICATIONS

Lee, M. et al., "A 9b,1.25 ps Resolution Coarse-Fine Time-to-Digital Converter in 90 nm CMOS that Amplifies a Time Residue", IEEE Journal of Solid-State Circuits, Apr. 2008, 43(4): 769-777.

Lee, S.K. et al., "A 1GHz ADPLL with a 1.25ps Minimum-Resolution Sub-Exponent TDC in 0.18 μm CMOS", IEEE Int. Solid-State Circuits Conf. (ISSCC), Feb. 2010, pp. 482-483.

* cited by examiner

*Primary Examiner* — Quan Tra
(74) *Attorney, Agent, or Firm* — Duane Morris LLP

(57) ABSTRACT

A time amplifier circuit has first and second inverters and first and second pull-down paths. Each inverter includes a first NMOS transistor and a first PMOS transistor. A source of the first NMOS transistor is coupled to a ground node directly or through a first additional NMOS transistor having a gate coupled to a respective input node. The first and second inverters are coupled to first and second input nodes and to first and second output nodes, respectively. The first pull-down path is from the first output node to the ground node and is enabled in response to the first input signal and the second output signal being high. The second pull-down path is from the second output node to ground and is enabled in response to the second input signal and the first output signal being high.

24 Claims, 8 Drawing Sheets

METHOD AND APPARATUS FOR AMPLIFYING A TIME DIFFERENCE

FIELD OF THE INVENTION

The present invention relates to time amplification devices.

BACKGROUND OF THE INVENTION

A time amplifier is an apparatus known in the art for amplification of a time difference between two signals. More precisely, a time amplifier, also known as a time difference amplifier, amplifies a difference between rising or falling edges of two signals. The gain of a time amplifier is defined as the ratio of the time difference between output signals from the amplifier and the time difference between input signals. High-gain time amplification is desirable for a variety of purposes, e.g., in the context of debugging a circuit in which one signal leads another by a small amount of time that challenges measurement capabilities.

SUMMARY OF THE INVENTION

A time amplifier circuit has first and second inverters and first and second pull-down paths. The first inverter includes a first NMOS transistor and a first PMOS transistor, with respective gates of the first NMOS and PMOS transistors coupled together to a first input node for receiving a first input signal. Respective drains of the first NMOS and PMOS transistors are coupled together to provide a first output signal at a first output node. A source of the first NMOS transistor is coupled to a ground node directly or through a first additional NMOS transistor having a gate coupled to the first input node. The second inverter comprises a second NMOS transistor and a second PMOS transistor, with respective gates of the second NMOS transistor and the second PMOS transistor coupled together to a second input node for receiving a second input signal. Respective drains of the second NMOS transistor and the second PMOS transistor are coupled together to provide a second output signal at a second output node. A source of the second NMOS transistor is coupled to the ground node directly or through a second additional NMOS transistor having a gate coupled to the second input node. The first pull-down path is from the first output node to the ground node and is enabled in response to the first input signal and the second output signal being high. The second pull-down path is from the second output node to ground and is enabled in response to the second input signal and the first output signal being high.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
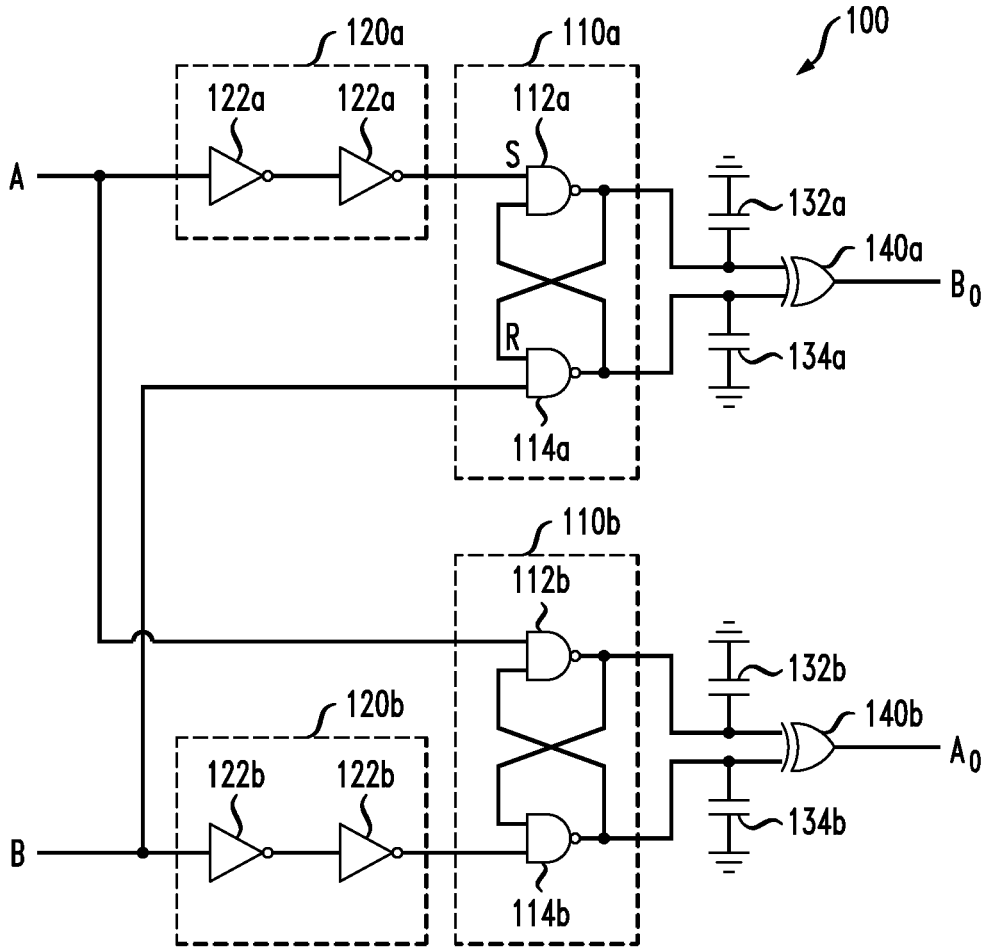
FIG. 1 PRIOR ART
FIG. 1 is a schematic diagram of a conventional time amplifier circuit using SR latches.

FIG. 1 is a schematic diagram of a conventional time amplifier circuit 100 using SR latches. Considering first only the NAND gates and the XOR gate in the top half of circuit 100, the basic principle of time amplification for circuit 100 may be understood as follows. A set-reset (SR) latch 110*a* includes cross-coupled NAND gates 112*a*, 114*a*. An input to NAND gate 112*a* may be a set (S) input, and an input to NAND gate 114*a* may be a reset (R) input. Ordinarily, SR latches are not intended to have both S and R asserted (e.g., at logic high, or '1') simultaneously. If rising edges are applied to S and to R at almost the same time, e.g., with S leading R by a small duration $\Delta T_{SR}$, latch 110*a* exhibits metastability. Eventually, latch 110*a* regenerates, reaching a stable configuration in which NAND gates 112*a* and 114*a* have different logic values. Thus, after a regeneration time $\Delta T_{reg}$ following the rising edge of R, the output $B_0$ of XOR gate 140*a* transitions from 0 to 1. As $\Delta T_{SR}$ decreases, $\Delta T_{reg}$ increases; thus, a crude delay profile is observed. By adding a delay to the S input of latch 110*a* via a delay line 120*a*, which may include a pair of inverters 122*a* as shown in FIG. 1, the delay profile may be shifted along the $\Delta T_{SR}$ axis in one direction. By using a similar circuit configuration but with a delay applied to another input, e.g., to an input of NAND gate 114*b*, a similar delay profile with an opposite shift may be obtained. By combining the two halves of circuit 100 and subtracting one delay profile from the other, a delay profile that is strictly increasing near $\Delta T_{SR}=0$ may be obtained. Thus, circuit 100 forms a time amplifier, so that when a rising edge of signal A leads a rising edge of signal B by a small amount $T_{in}$, a rising edge of output $A_0$ leads a rising edge of output $B_0$ by a larger amount $T_{out}$. The small-signal gain of circuit 100 is $2C/(g_m T_{off})$, where C is the capacitance of capacitors 132*a*, 132*b*, 134*a*, 134*b*, $g_m$ is the transconductance of NAND gates 112*a*, 112*b*, 114*a*, 114*b*, and $T_{off}$ is the time offset provided by delay lines 120*a*, 120*b*. In practice, the small-signal gain of circuit 100 may be about 10. Circuit 100 exhibits nonmonotonic delay outside of an interval centered at $T_{in}=0$, as $T_{out}$ decreases in magnitude when $T_{in}$ exceeds $T_{off}$ in magnitude.

Figure 2:
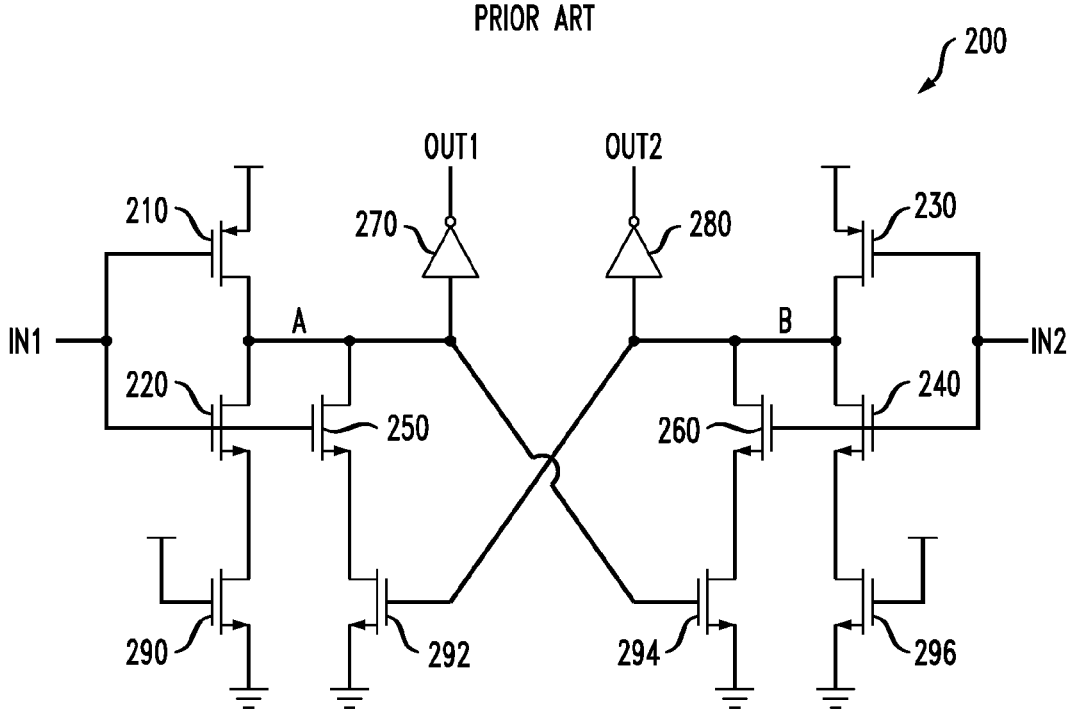
FIG. 2 PRIOR ART
FIG. 2 is a schematic of another time amplifier circuit using CMOS transistors.

FIG. 2 is a schematic diagram of another time amplifier circuit 200 using metal oxide semiconductor (MOS) transistors. Initially, inputs IN1 and IN2 may be at a low voltage state (logic '0'). PMOS transistor 210 and NMOS transistor 220 form an inverter, and PMOS transistor 230 and NMOS transistor 240 form another inverter, so that nodes A and B are initially precharged to a power supply voltage, commonly referred to as $V_{DD}$ (logic '1'). When rising edges of IN1 and IN2 arrive at different times, e.g., with IN1 leading IN2, node A is discharged (pulled down) via two paths, with one path formed by NMOS transistors 220 and 290 and another path formed by NMOS transistors 250 and 292. Node B, which starts to discharge later than node A due to the later arrival of the rising edge of IN2, is discharged via only one path at the end of the transition, i.e., via NMOS transistors 240 and 296, because the path formed by NMOS transistors 260 and 294 is disabled due to the coupling between node A (which is low) and the gate of transistor 294. If transistors 290, 292, 294, and 296 are identical in size, then the gain of circuit 200 may be about two, i.e., rising edges of OUT1 and OUT2 may differ in time by about twice the time difference between rising edges of IN1 and IN2.

Figure 3A:
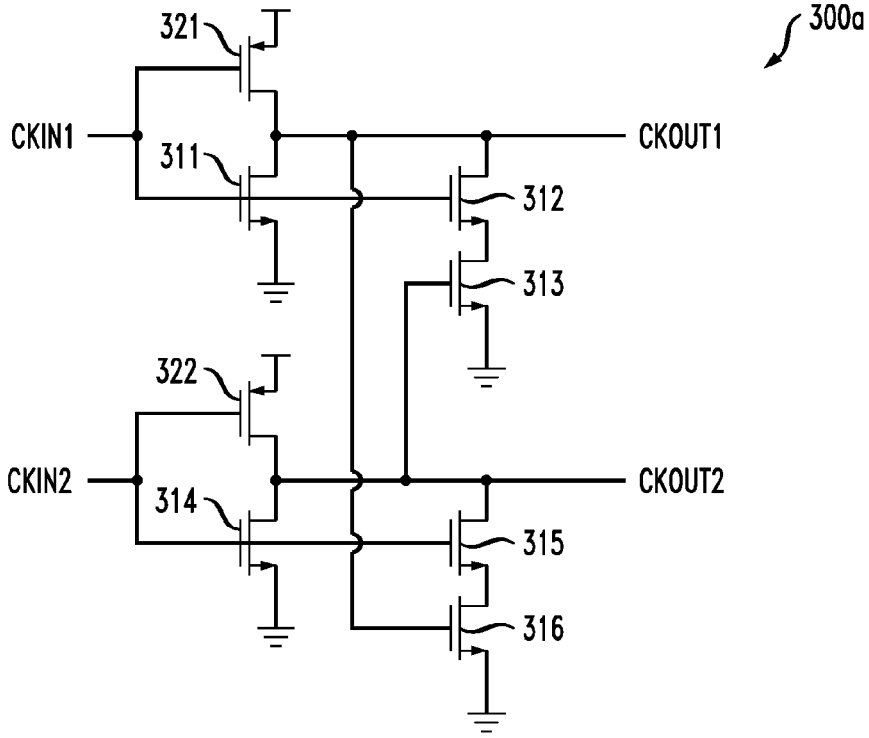
FIGS. 3A-B are schematic diagrams of time amplifier circuits in accordance with various embodiments of the present invention.
Figure 3B:
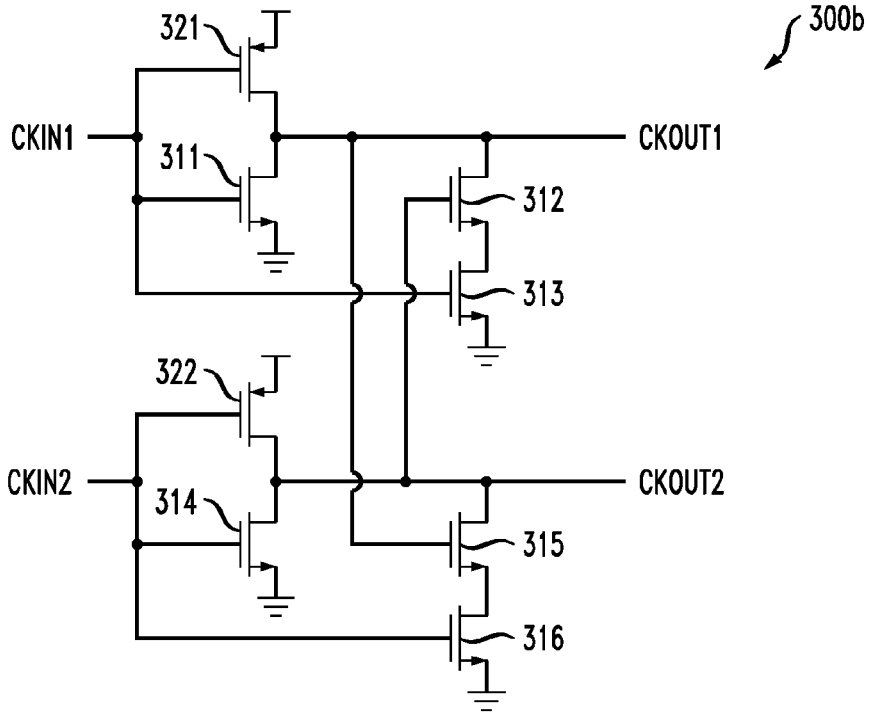

FIGS. 3A-B are schematic diagrams of time amplifier circuits in accordance with various embodiments of the present invention. Referring to FIG. 3A, circuit 300*a* provides an input signal CKIN1 at a first input node coupled to the gate of an NMOS transistor 311 and to the gate of a PMOS transistor 321. Transistors 311 and 321 are connected to form an inverter, with their drains coupled to each other, a source of transistor 311 coupled to a ground node ("ground"), and a source of transistor 321 coupled to a power supply node (e.g., $V_{DD}$). In some embodiments, additional circuit elements may be present between transistor 321 and $V_{DD}$. An output signal CKOUT1 is provided at a first output node coupled to the drains of transistors 311 and 321. A pull-down path is provided by NMOS transistors 312 and 313. NMOS transistor 312 has a gate coupled to the first input node and a drain coupled to the first output node. NMOS transistor 313 has a drain coupled to a source of transistor 312. In the example shown in FIG. 3A, a source of transistor 313 is grounded, but in some embodiments, additional circuit elements may be present between transistor 313 and ground.

The lower half of circuit 300*a* in FIG. 3A is similar to the upper half. An input signal CKIN2 is provided at a second input node coupled to the gate of an NMOS transistor 314 and to the gate of a PMOS transistor 322. Transistors 314 and 322 are connected to form an inverter, with their drains coupled to each other, a source of transistor 314 coupled to ground, and a source of transistor 322 coupled to $V_{DD}$. In some embodiments, additional circuit elements may be present between transistor 322 and $V_{DD}$. An output signal CKOUT2 is provided at a second output node coupled to the drains of transistors 314 and 322. NMOS transistors 315 and 316 provide a pull-down path. NMOS transistor 315 has a gate coupled to the second input node and a drain coupled to the second output node. NMOS transistor 316 has a drain coupled to a source of transistor 315. In the example shown in FIG. 3A, a source of transistor 316 is grounded, but in some embodiments, additional circuit elements may be present between transistor 316 and ground. Gates of transistors 312, 313, 315, 316 are coupled to the first input node, the second output node, the second input node, and the first output node, respectively.

The operation of circuit 300*a* as a time amplifier may be understood as follows. Suppose a rising edge of CKIN1 leads a rising edge of CKIN2. Before CKIN1 transitions high, transistors 311, 312, 314, and 315 function as switches that are in the "off" state (do not permit current to flow between source and drain), transistors 321, 313, 322, and 316 function as switches that are in the "on" state (permit current to flow), and the first and second output nodes are both at high voltage ('1'). When CKIN1 transitions high, transistors 311 and 312 turn on, enabling the first output node to discharge via transistors 312, 313 (which is a pull-down path dependent on the second output node, thus a "dependent" pull-down path) and via transistor 311 (a pull-down path independent of the second output node, thus an "independent" pull-down path). Later, when CKIN2 transitions high, transistor 314 turns on, enabling the second output node to be pulled down, but transistor 316 is off near the end of the transition due to the first output node having discharged previously. Thus, the second output node is pulled down by only an independent pull-down path (a path independent of the first output node) and consequently discharges slower than the first output node. As a result, falling edges of CKOUT1 and CKOUT2 are separated by a greater time difference than rising edges of CKIN1 and CKIN2, i.e., time amplification is exhibited.

Circuit 300*b* in FIG. 3B is similar to circuit 300*a* but differs in the details of the cross-coupling. In circuit 300*b*, the gates of transistors 312, 313, 315, 316 are coupled to the second output node, the first input signal, the first output node, and the second input signal, respectively. The operation of circuit 300*b* is substantially similar to that of circuit 300*a*, as one of ordinary skill in the art appreciates, and need not be described further. Circuit 300*b* has been tested to achieve slightly higher gain than circuit 300*a*.

Advantageously, circuits 300*a* and 300*b* employ fewer components than prior circuit 200, e.g., as few as 8 MOS transistors in embodiments shown in FIGS. 3A-B compared with 14 MOS transistors in prior art circuit 200. Particularly, delay lines 120*a*, 120*b* of prior art circuit 100 and transistors 290, 296 of prior art circuit 200 are not used in circuits 300*a* and 300*b*, resulting in decreased intrinsic delay time (less than 100 ps) and decreased power consumption. Additionally, various embodiments exhibit increased small signal gain relative to prior art approaches, and the small signal gain is proportional to intrinsic delay time and always greater than unity.

Figure 4A:
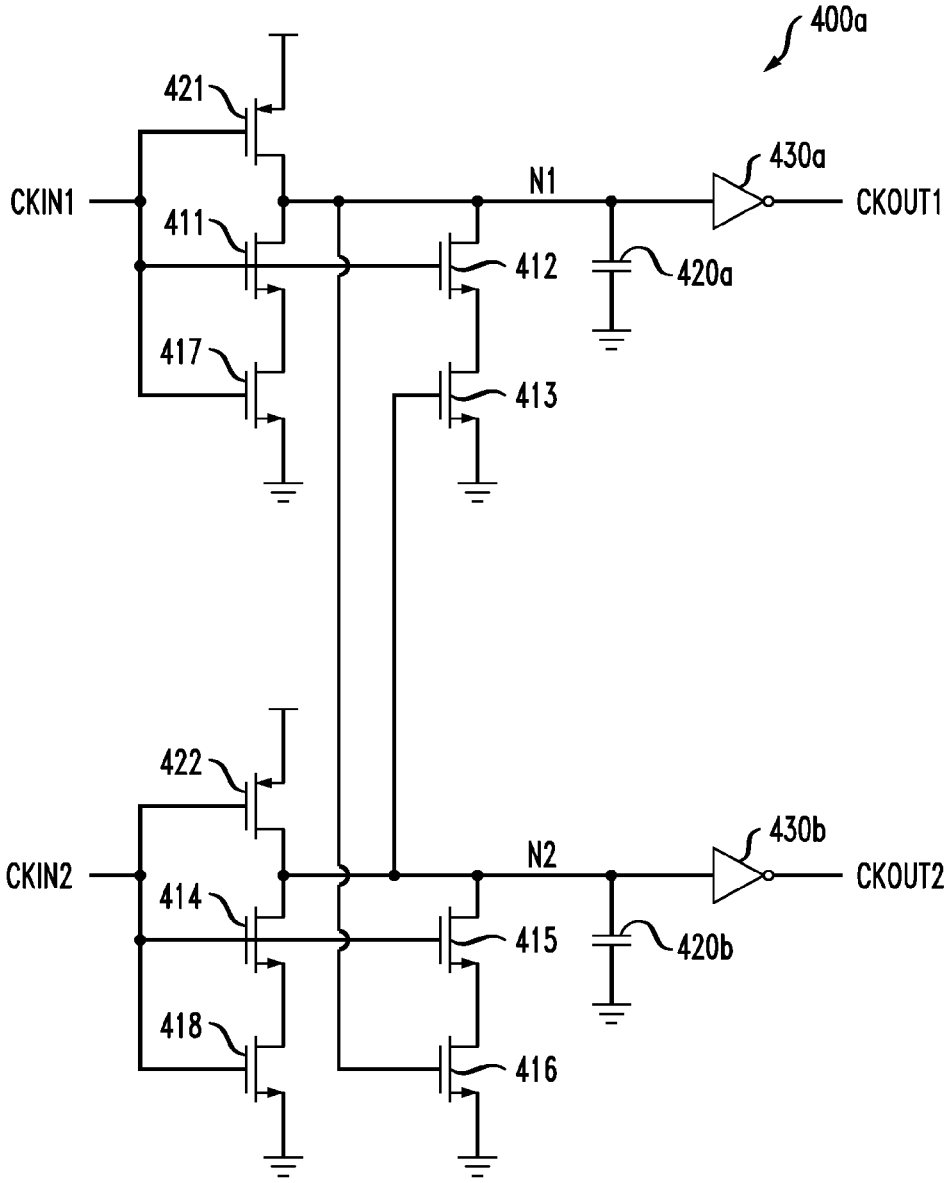
FIGS. 4A-B are schematic diagrams of time amplifier circuits in accordance with various other embodiments of the present invention.
Figure 4B:
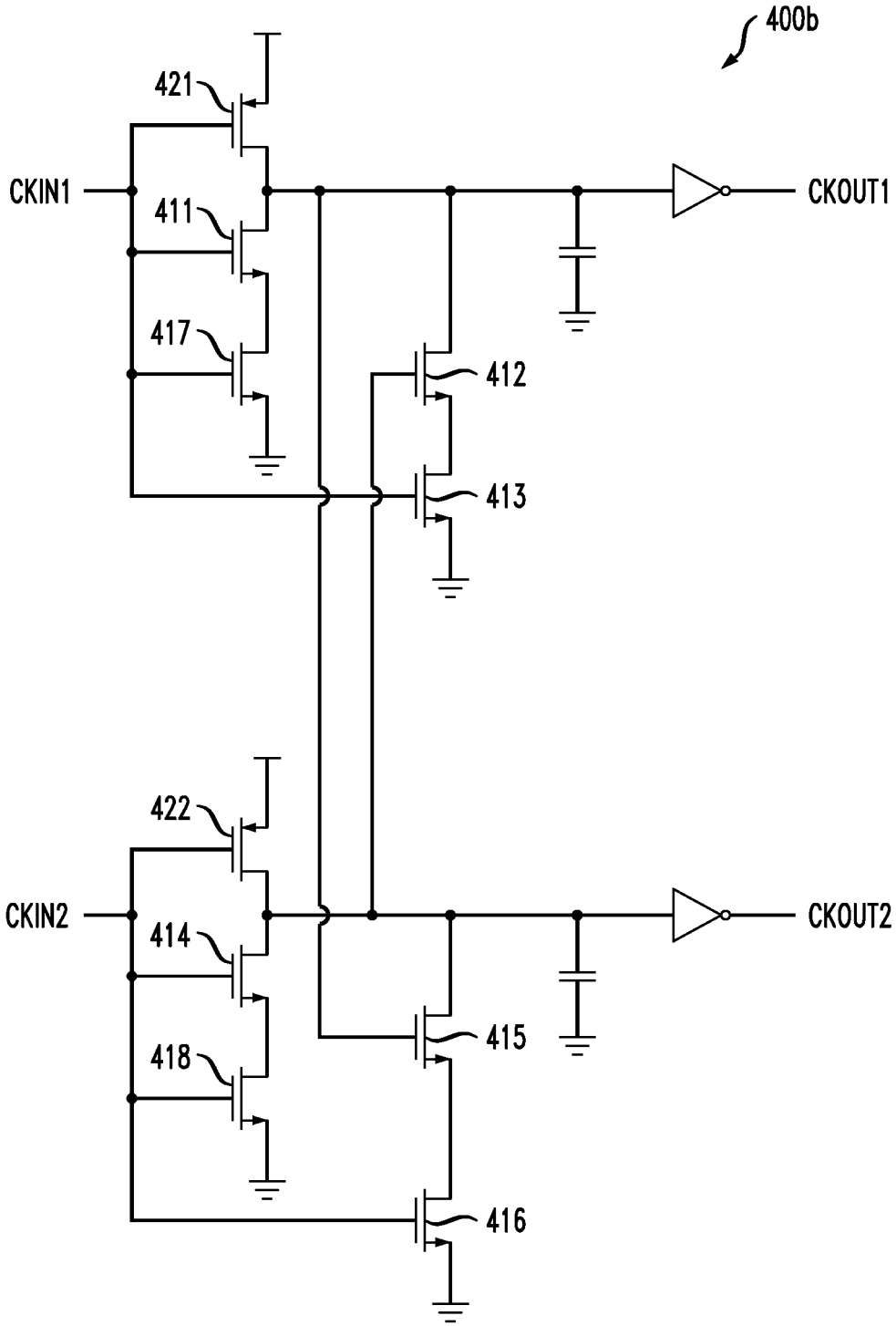

FIGS. 4A-B are schematic diagrams of time amplifier circuits in accordance with various other embodiments. Circuit 400*a* in FIG. 4A is similar to circuit 300*a*, with like reference numerals, differing in prefix (e.g., 4xx vs. 3xx) attached to like elements. For brevity, only the differences between circuits 400*a* and 300*a* are described below. Circuit 400*a* optionally includes capacitors 420*a* and 420*b*, which increase the gain of the time amplifier circuit. Inverters 430*a* and 430*b* are also optional and receive their inputs at nodes N1 and N2, respectively, which correspond to the first and second output nodes of FIGS. 3A-B. Inverters 430*a*, 430*b* correct the polarity of the outputs, so that CKOUT1 and CKOUT2 transition high following rising edges CKIN1 and CKIN2. Circuit 400*a* includes additional NMOS transistors 417 and 418. Inverters 430*a*, 430*b* also advantageously affect the slew rate as follows. Supposing that CKIN1 leads CKIN2, employing inverters 430*a*, 430*b* sharpens the rising edges of CKOUT1 and CKOUT2 (increases slew rate, or maximum rate of change of voltage with respect to time), which decreases intrinsic delay time, as discussed below in the context of FIG. 5.

Transistors 417 and 418 have gates coupled to the first and second input nodes, respectively (the nodes providing CKIN1 and CKIN2) and drains coupled to the sources of transistors 411 and 414, respectively. In the example shown in FIG. 4A, a source of transistor 417 is grounded; in other embodiments, other NMOS transistors may be present between transistor 417 and ground, with each of the other NMOS transistors having a gate coupled to the first input node. Similarly, other NMOS transistors all having gates coupled to the second input node may be present between transistor 418 and ground in other embodiments. Transistors 417 and 418 may be employed to provide symmetry, e.g., so that dependent and independent paths each have two transistors, which may make gain easier to predict.

Circuit 400*b* in FIG. 4B is similar to circuit in 400*a* in much the same way that circuit 300*b* is similar to circuit 300*a*, i.e., only cross-coupling details differ. In circuit 400*b*, the gates of transistors 412, 413, 415, 416 are coupled to the second output node, the first input signal, the first output node, and the second input signal, respectively. Circuit 400*b* has been tested to achieve higher gain (e.g., about 2% higher) than circuit 400*a*, which has a small signal gain of about 30.

As shown in FIGS. 4A-B, NMOS transistor 417 has a gate coupled to a first input node providing CKIN1, and NMOS transistor 418 has a gate coupled to a second input node providing CKIN2, unlike the configuration of circuit 200, in which similar transistors have gates coupled to a node that is permanently at a high voltage (power supply voltage). Coupling gates of transistors 417, 418 to input nodes that vary in voltage with the input signals instead of to high voltage nodes results in increased gain. The equivalent size (width-to-length, or W/L) of transistors 411 and 417 may be half of the sizes of transistors 220 and 290 in FIG. 2. In circuit 400*a*, the transistors 411 and 417 are connected in series, and the equivalent sizes and transconductance are reduced, and the amplified gain is increased relative to circuit 200. In FIG. 2, the gate of transistor 290 is connected to $V_{DD}$, so the drain of transistor 290 is always discharged to low. Therefore, the equivalent size and transconductance of transistor 220 is not reduced, and the amplified gain is also not changed. Therefore, adding the transistor 417 in series with transistor 411 reduces the equivalent transconductance of transistor 411 and increases the gain of the time amplifier. If the sizes (W/L) of transistors 411 and 417 are the same, the amplified gain is twice that of that of circuit 200.

Figure 5:
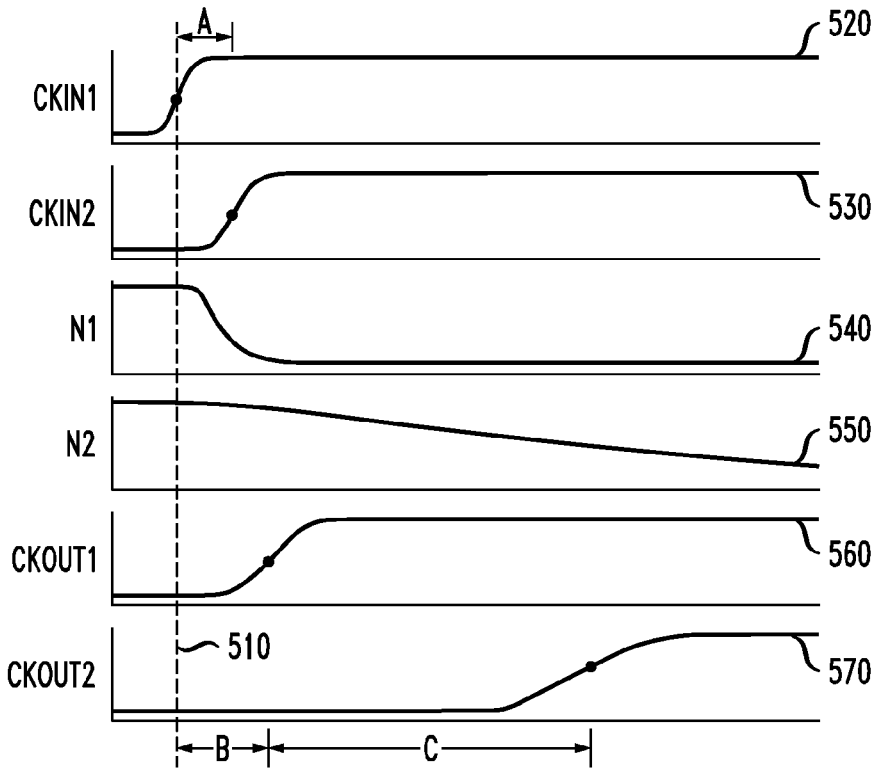
FIG. 5 is a plot of performance of a time amplifier circuit in accordance with an embodiment as in FIG. 4A.

FIG. 5 is a plot of performance of a time amplifier circuit in accordance with an embodiment as in FIG. 4A. In FIG. 5, a rising edge of CKIN1 is shown in plot 520 to lead a rising edge of CKIN2, shown in plot 530, by a time difference denoted A. FIG. 5 follows the convention that a transition time corresponds to a point in time at which a voltage is halfway between a minimum voltage and a maximum voltage of a transition. For example, a rising transition of CKIN1 may be considered to occur at the time denoted by dashed line 510. FIG. 5 also shows voltages at nodes N1 and N2 of FIG. 4A plotted over time in plots 540 and 550, respectively. The intrinsic delay time between CKIN1 and CKOUT1 is denoted B. When the slew rate is increased, e.g., the edge of CKOUT1 is sharpened, via an inverter as discussed above, intrinsic delay is reduced. Output signals CKOUT1 and CKOUT2 are shown in plots 560, 570 to transition high at times separated by a duration C. The property of time amplification is evident in FIG. 5. Durations A, B, and C have been observed in one case to be about 30 ps, 70 ps, and 379 ps, respectively, resulting in a gain of about 379/30=12.63.

For symmetry, transistor 411 of FIG. 4A may be sized (in terms of width-to-length ratio) the same as transistor 414. Similarly, transistors 412, 413, and 417 may be sized the same as transistors 414, 415, and 418, respectively. Providing such symmetry provides the advantage that the gain is the same or nearly the same regardless of which input signal leads the other. Gain may be increased by increasing the size (width-to-length) ratios of transistor 412 to transistor 411 and of transistor 415 to transistor 414 to a value between 12 and 20. Gain may also be increased by increasing the size of capacitors 420*a*, 420*b*.

Figure 6:
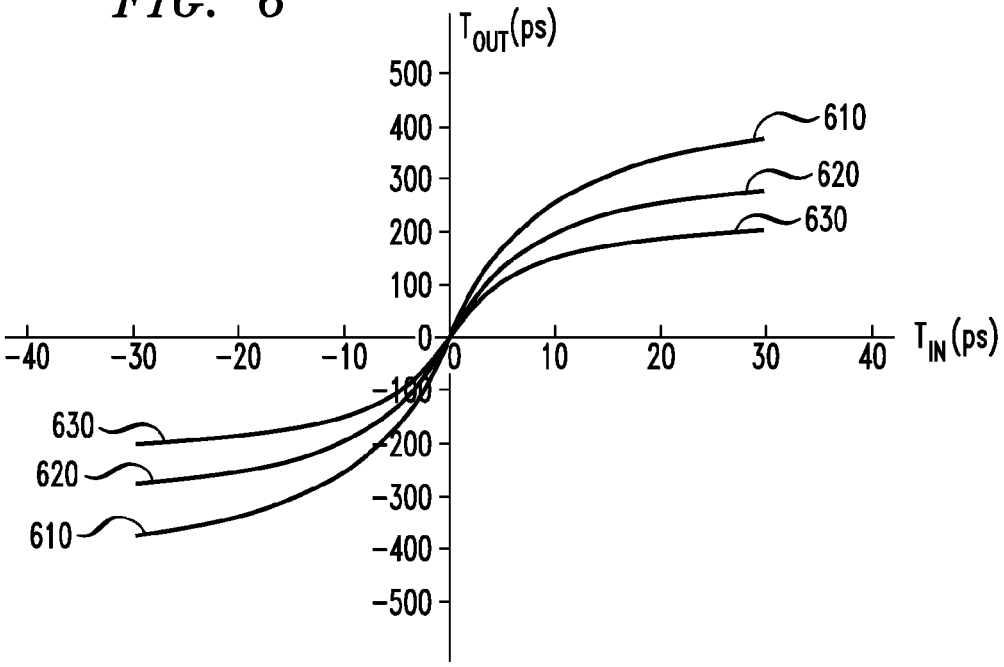
FIG. 6 is a plot of delay profiles in accordance with an embodiment as in FIG. 4A.

FIG. 6 is a plot of delay profiles in accordance with an embodiment as in FIG. 4A. Transistor 411 may be sized the same as transistor 417, transistor 412 may be sized the same as transistor 413, and the ratio of width-to-length parameters between transistors 412 and 411 may be about 16. For example, transistor 412 may have a width of about 1.6 μm and a length of about 60 nm, i.e., a width-to-length ratio about 26.67, and transistor 411 may have a width of about 0.2 μm and a length of about 120 nm, i.e., a width-to-length ratio of about 1.67. Width-to-length ratio is a relevant size parameter because the transconductance of a transistor is proportional to this parameter. Performance may be as shown in FIG. 6. In FIG. 6, $T_{out}$, i.e., the time between output edges, is plotted against $T_{in}$, i.e., the time between input edges, for three operating conditions: slow PMOS/NMOS processes at 100° C. (plot 610); typical PMOS/NMOS processes at 40° C. (plot 620); and fast-evolving PMOS/NMOS processes at 0° C. (plot 630). Unlike prior art circuit 100, FIG. 6 shows that the magnitude of $T_{out}$ increases monotonically as the magnitude of $T_{in}$ increases, not just in a narrow interval centered at $T_{in}$=0. When $T_{in}$=1 ps, gain is approximately 29.8 for plot 630, which is higher small-signal gain than is available with conventional time amplifiers. When $T_{in}$=10 ps, observed values of gain for plots 610, 620, and 630 are approximately 25, 20, and 15, respectively. Small-signal gain has been observed to be proportional to intrinsic delay time.

Figure 7A:
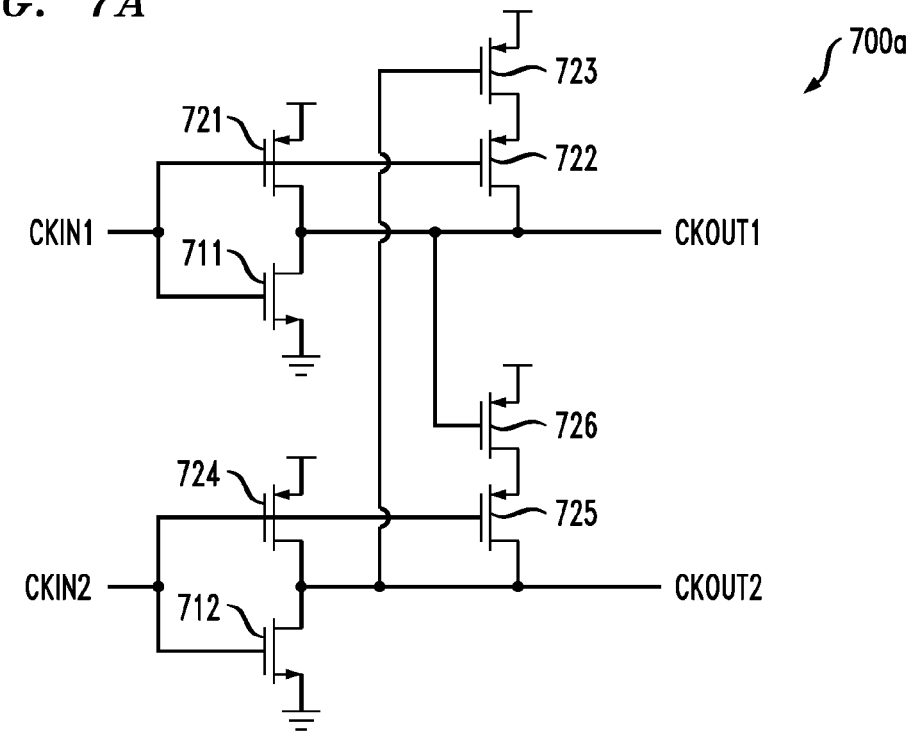
FIGS. 7A-B are schematic diagrams of time amplifier circuits for a falling edge case in accordance with various embodiments of the present invention.
Figure 7B:
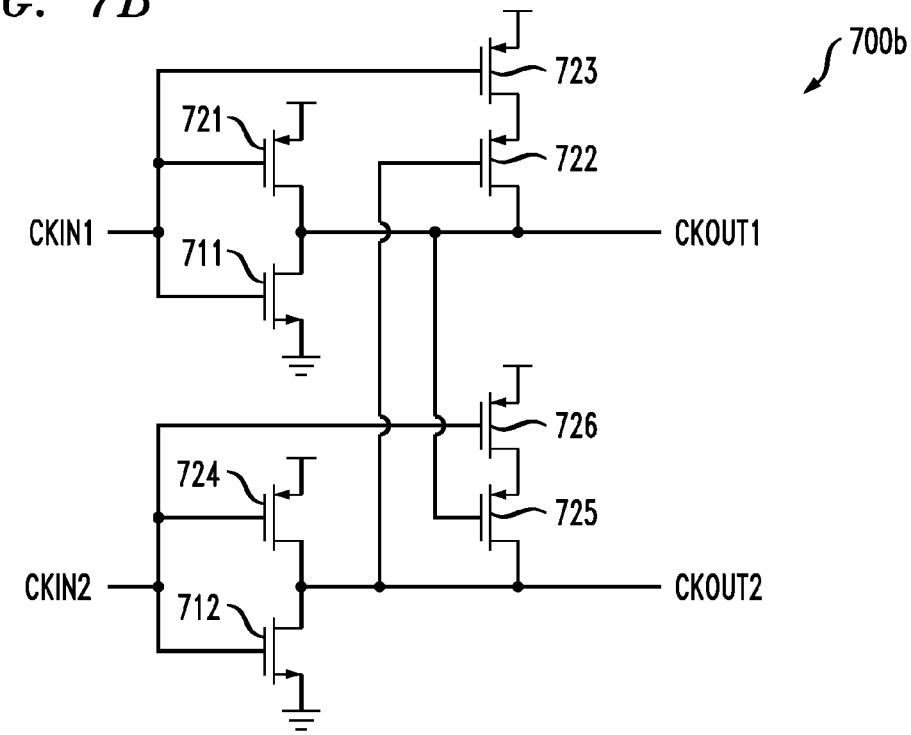

FIGS. 7A-B are schematic diagrams of time amplifier circuits for a falling edge scenario in accordance with various embodiments. Unlike circuits in FIGS. 3A-B and 4A-B, which employ primarily NMOS transistors, circuit 700*a* employs primarily PMOS transistors to amplify a time difference between falling edge transitions of input signals CKIN1 and CKIN2. Circuit 700*a* is similar in many respects to circuit 300*a*, as will be apparent from the discussion below.

Referring to FIG. 7A, circuit 700*a* provides an input signal CKIN1 at a first input node coupled to the gate of an NMOS transistor 711 and to the gate of a PMOS transistor 721. Transistors 711 and 721 are connected to form an inverter, with their drains connected to each other, a source of transistor 711 coupled to ground, and a source of transistor 721 coupled to a power supply node (e.g., $V_{DD}$). In some embodiments, additional circuit elements may be present between transistor 711 and ground. An output signal CKOUT1 is provided at a first output node coupled to the drains of transistors 711 and 721. A PMOS transistor 722 has a gate coupled to the first input node and a drain coupled to the first output node. A PMOS transistor 713 has a drain coupled to a source of transistor 722. In the example shown in FIG. 7A, a source of transistor 723 is coupled to the power supply node, but in some embodiments, additional circuit elements may be present between transistor 723 and the power supply node.

The lower half of circuit 700*a* in FIG. 7A is similar to the upper half. An input signal CKIN2 is provided at a second input node coupled to the gate of an NMOS transistor 712 and to the gate of a PMOS transistor 724. Transistors 712 and 724 are connected to form an inverter, with their drains connected to each other, a source of transistor coupled to ground, and a source of transistor 724 coupled to $V_{DD}$, respectively. In some embodiments, additional circuit elements may be present between transistor 711 and ground. An output signal CKOUT2 is provided at a second output node coupled to the drains of transistors 714 and 722. A PMOS transistor 725 has a gate coupled to the second input node and a drain coupled to the second output node. A PMOS transistor 726 has a drain coupled to a source of transistor 725. In the example shown in FIG. 7A, a source of transistor 726 is coupled to the power supply node, but in some embodiments, additional circuit elements may be present between transistor 726 and the power supply node. Gates of transistors 722, 723, 725, 726 are coupled to the first input node, the second output node, the second input node, and the first output node, respectively.

Suppose CKIN1 leads CKIN2, and CKIN1 and CKIN2 are initially both at a high voltage ('1'). Then the first and second output nodes are initially at a low voltage ('0'), transistors 711, 712, 723, and 726 function as switches that are "on," and transistors 721, 722, 724, and 725 function as switches that are "off." When CKIN1 transitions low, transistors 721 and 722 are turned on, and the first output node is pulled up via a path dependent on the second output node (a path comprising transistors 722, 723) and via an independent pull-up path comprising transistor 721. When CKIN2 later transitions low, the second output node is only pulled up via an independent pull-up path comprising transistor 724, because a path dependent on the first output node (a path comprising transistors 725, 726) is disabled at the end of the transition due to the first output node (which is coupled to the gate of transistor 726) being at a high voltage. Consequently, a time difference between edges of CKOUT1 and CKOUT2 is greater than a time difference between falling edges of CKIN1 and CKIN2, i.e., circuit 700*a* is a time amplifier. Thus, circuit 700*a* operates much as circuit 300*a* does but with reversed logic (e.g., pull-up paths instead of pull-down paths).

Just as circuit 300*a* is similar to circuit 300*b* except for cross-coupling details, so is circuit 700*a* similar to circuit 700*b* except for cross-coupling details. In circuit 700*b*, the gates of transistors 722, 723, 725, and 726 are coupled to the second output node, the first input node, the first output node, and the second input node, respectively. Circuit 700*b* exhibits higher gain than 700*a*, and the gain for circuits 700*a*, 700*b* is similar to the gain for circuits 300*a*, 300*b*, respectively. To accommodate a situation in which amplification of rising and falling edges is sought, dependent pull-down paths as in circuits 300*a*, 300*b* or circuits 400*a*, 400*b* may be added to circuits 700*a*, 700*b*.

Circuits 700*a*, 700*b* may optionally have capacitors (not shown in FIGS. 7A-B) coupled to output nodes as in circuits 400*a*, 400*b* for increased gain, and they may optionally have inverters (not shown) at the output nodes as in circuits 400*a*, 400*b* for increased slew rate and gain and for polarity correction. Circuits 700*a*, 700*b* may have one or more additional PMOS transistors (not shown) between transistor 721 and the power supply node, with the additional PMOS transistors all having gates coupled to the first input signal. Similarly, circuits 700*a*, 700*b* may have one or more additional PMOS transistors (not shown), all having gates coupled to the second input signal, between transistor 724 and the power supply node. Circuits 700*a*, 700*b* have similar advantages relative to the prior art as do circuits 300*a*, 300*b* described above.

Figure 8:
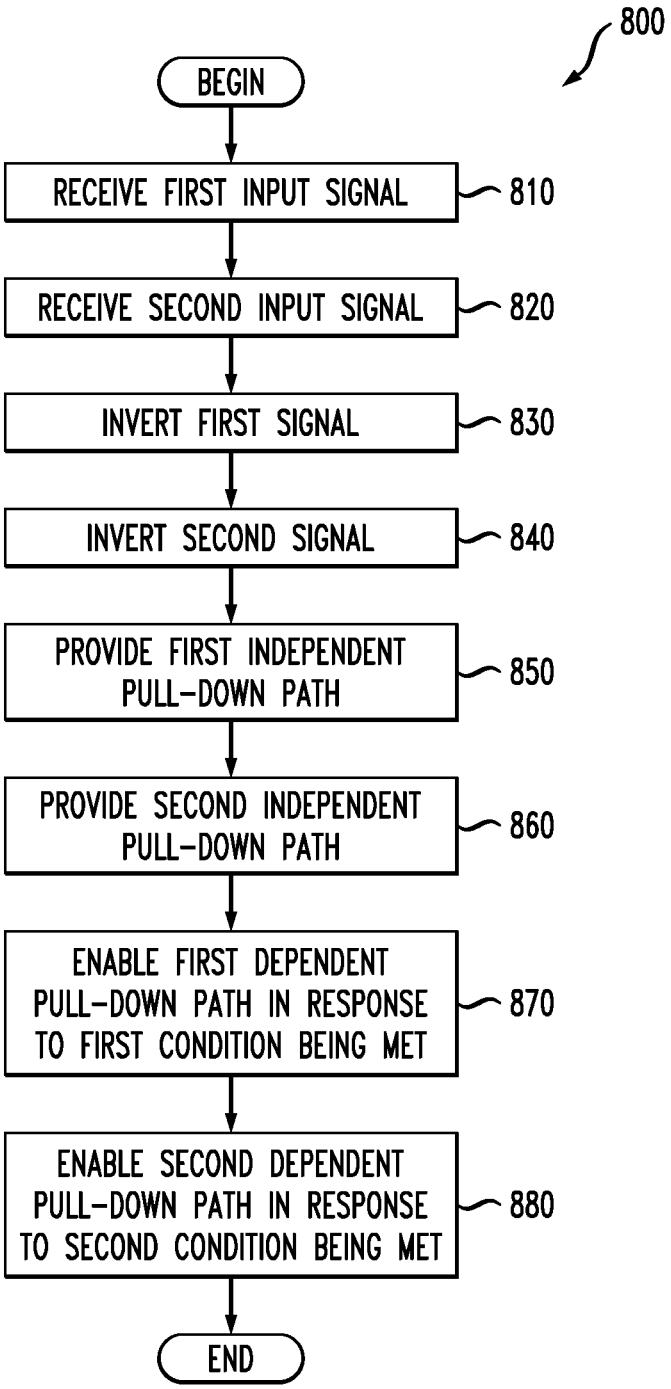
FIG. 8 is a flow diagram illustrating a time amplification method in accordance with an embodiment of the present invention.

FIG. 8 is a flow diagram illustrating a method for amplifying a time difference between rising edges of two signals. After process 800 begins, a first input signal is received (810), and a second input signal is received (820). The first input signal is inverted (830) to provide a first output signal, and the second input signal is inverted (840) to provide a second output signal. A first independent pull-down path is provided (850), and a second independent pull-down path is provided (860). The meaning of the terms "independent" and "dependent" is as described above. A first dependent pull-down path is enabled (870) in response to a first condition being met. The first condition may be that the first input signal and the second output signal are high. A second dependent pull-down path is enabled (880) in response to a second condition being met. The second condition may be that the second input signal and the first output signal are high.

Another embodiment is a method for amplifying a time difference between falling edges of two signals. First and second input signals are received. The first and second input signals are inverted to provide first and second output signals, respectively. First and second independent pull-up paths are provided. A first dependent pull-up path is enabled in response to a first condition being met. The first condition may be that the first input signal and the second output signal are low. A second dependent pull-up path is enabled in response to a second condition being met. The second condition may be that the second input signal and the first output signal are low.

The above illustrations provide many different embodiments for implementing different features of this invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A time amplifier circuit comprising:

a first inverter comprising a first NMOS transistor and a first PMOS transistor, respective gates of the first NMOS and PMOS transistors coupled together to a first input node for receiving a first input signal, respective drains of the first NMOS and PMOS transistors coupled together to provide a first output signal at a first output node, a source of the first NMOS transistor coupled to a ground node through a first additional NMOS transistor having a gate coupled to the first input node;

a second inverter comprising a second NMOS transistor and a second PMOS transistor, respective gates of the second NMOS transistor and the second PMOS transistor coupled together to a second input node for receiving a second input signal, respective drains of the second NMOS transistor and the second PMOS transistor coupled together to provide a second output signal at a second output node, a source of the second NMOS transistor coupled to the ground node through a second additional NMOS transistor having a gate coupled to the second input node;

a first pull-down path, from the first output node to the ground node, enabled in response to the first input signal and the second output signal being high; and a second pull-down path, from the second output node to ground, enabled in response to the second input signal and the first output signal being high;

wherein the voltage at the first input node is independent of the voltage at the second input node.

2. The time amplifier circuit of claim 1 wherein:

the first pull-down path comprises:

a third NMOS transistor having a gate coupled to the first input node and a drain coupled to the first output node, and a fourth NMOS transistor having a gate coupled to the second output node and a drain coupled to a source of the third NMOS transistor; and the second pull-down path comprises:

a fifth NMOS transistor having a gate coupled to the second input node and a drain coupled to the second output node, and a sixth NMOS transistor having a gate coupled to the first output node and a drain coupled to a source of the fifth NMOS transistor.

3. The time amplifier circuit of claim 2, wherein a size parameter of the first NMOS transistor is about equal to a size parameter of the second NMOS transistor, a size parameter of the third NMOS transistor is about equal to a size parameter of the fifth NMOS transistor, a size parameter of the fourth NMOS transistor is about equal to a size parameter of the sixth NMOS transistor, and a size parameter of the first additional NMOS transistor is about equal to a size parameter of the second additional NMOS transistor, wherein the size parameters of the respective transistors are ratios between width and length of the respective transistors.

4. The time amplifier circuit of claim 3, wherein the size parameter of the third NMOS transistor is about equal to the size parameter of the fourth NMOS transistor, and the size parameter of the first NMOS transistor is about equal to the size parameter of the first additional NMOS transistor.

5. The time amplifier circuit of claim 3, wherein a ratio of the size parameter of the third NMOS transistor to the size parameter of the first NMOS transistor is between 12 and 20.

6. The time amplifier circuit of claim 1 wherein:

the first pull-down path comprises:

a third NMOS transistor having a gate coupled to the second output node and a drain coupled to the first output node, and a fourth NMOS transistor having a gate coupled to the first input node and a drain coupled to a source of the third NMOS transistor; and the second pull-down path comprises:

a fifth NMOS transistor having a gate coupled to the first output node and a drain coupled to the second output node, and a sixth NMOS transistor having a gate coupled to the second input node and a drain coupled to a source of the fifth NMOS transistor.

7. The time amplifier circuit of claim 6, wherein a size parameter of the first NMOS transistor is about equal to a size parameter of the second NMOS transistor, a size parameter of the third NMOS transistor is about equal to a size parameter of the fifth NMOS transistor, a size parameter of the fourth NMOS transistor is about equal to a size parameter of the sixth NMOS transistor, and a size parameter of the first additional NMOS transistor is about equal to a size parameter of the second additional NMOS transistor, wherein the size parameters of the respective transistors are ratios between width and length of the respective transistors.

8. The time amplifier circuit of claim 7, wherein the size parameter of the third NMOS transistor is about equal to the size parameter of the fourth NMOS transistor, and the size parameter of the first NMOS transistor is about equal to the size parameter of the first additional NMOS transistor.

9. The time amplifier circuit of claim 7, wherein a ratio of the size parameter of the third NMOS transistor to the size parameter of the first NMOS transistor is between 12 and 20.

10. The time amplifier circuit of claim 1, further including first and second capacitors coupled to the first and second output nodes, respectively.

11. The time amplifier circuit of claim 1, further including third and fourth inverters having inputs coupled to the first and second output nodes, respectively.

12. A time amplifier circuit comprising:

a first inverter comprising a first NMOS transistor and a first PMOS transistor, respective gates of the first NMOS and PMOS transistors coupled together to a first input node for receiving a first input signal, respective drains of the first NMOS and PMOS transistors coupled together to provide a first output signal at a first output node, a source of the first PMOS transistor coupled to a power supply node through a first additional PMOS transistor having a gate coupled to the first input node;

a second inverter comprising a second NMOS transistor and a second PMOS transistor, respective gates of the second NMOS transistor and the second PMOS transistor coupled together to a second input node for receiving a second input signal, respective drains of the second NMOS transistor and the second PMOS transistor coupled together to provide a second output signal at a second output node, a source of the second PMOS transistor coupled to the power supply node through a second additional PMOS transistor having a gate coupled to the second input node;

a first pull-up path, from the first output node to the power supply node, enabled in response to the first input signal and the second output signal being low; and a second pull-up path, from the second output node to the power supply node, enabled in response to the second input signal and the first output signal being low;

wherein the voltage at the first input node is independent of the voltage at the second input node.

13. The time amplifier circuit of claim 12 wherein:

the first pull-up path comprises:

a third PMOS transistor having a gate coupled to the first input node and a drain coupled to the first output node, and a fourth PMOS transistor having a gate coupled to the second output node and a drain coupled to a source of the third PMOS transistor; and the second pull-up path comprises:

a fifth PMOS transistor having a gate coupled to the second input node and a drain coupled to the second output node, and a sixth PMOS transistor having a gate coupled to the first output node and a drain coupled to a source of the fifth PMOS transistor.

14. The time amplifier circuit of claim 12 wherein:

the first pull-up path comprises:

a third PMOS transistor having a gate coupled to the second output node and a drain coupled to the first output node, and a fourth PMOS transistor having a gate coupled to the first input node and a drain coupled to a source of the third PMOS transistor; and the second pull-up path comprises:

a fifth PMOS transistor having a gate coupled to the first output node and a drain coupled to the second output node, and a sixth PMOS transistor having a gate coupled to the second input node and a drain coupled to a source of the fifth PMOS transistor.

15. A method of amplifying a time difference between rising edges of two signals, the method comprising:

receiving a first input signal and a second input signal;

inverting the first signal to provide a first output signal at a first output node;

inverting the second input signal to provide a second output signal at a second output node;

providing a first independent pull-down path from the first output node to a ground node through two or more NMOS transistors biased by the first input signal, wherein the first independent pull-down path is provided independent of a voltage at the second output node;

providing a second independent pull-down path from the second output node to the ground node through two or more NMOS transistors biased by the second input signal, wherein the second independent pull-down path is provided independent of a voltage at the first output node;

enabling a first dependent pull-down path from the first output node to the ground node in response to a first condition being met; and enabling a second dependent pull-down path from the second output node to the ground node in response to a second condition being mets, wherein the first input signal is independent of the second input signal; and wherein the first condition is that the first input signal and the second output signal are high, and the second condition is that the second input signal and the first output signal are high.

16. A time amplifier circuit comprising:

a first inverter comprising a first NMOS transistor and a first PMOS transistor, respective gates of the first NMOS and PMOS transistors coupled together to a first input node for receiving a first input signal, respective drains of the first NMOS and PMOS transistors coupled together by a first output node to provide a first output signal at the first output node, a source of the first NMOS transistor coupled directly to a ground node;

a second inverter comprising a second NMOS transistor and a second PMOS transistor, respective gates of the second NMOS transistor and the second PMOS transistor coupled together to a second input node for receiving a second input signal, respective drains of the second NMOS transistor and the second PMOS transistor coupled together by a second output node to provide a second output signal at the second output node, a source of the second NMOS transistor coupled directly to the ground node;

a first pull-down path, from the first output node to the ground node, enabled in response to the first input signal and the second output signal being high; and a second pull-down path, from the second output node to ground, enabled in response to the second input signal and the first output signal being high;

wherein the voltage at the first input node is independent of the voltage at the second input node.

17. The time amplifier circuit of claim 16 wherein:

the first pull-down path comprises:

a third NMOS transistor having a gate coupled to the first input node and a drain coupled to the first output node, and a fourth NMOS transistor having a gate coupled to the second output node and a drain coupled to a source of the third NMOS transistor; and the second pull-down path comprises:

a fifth NMOS transistor having a gate coupled to the second input node and a drain coupled to the second output node, and a sixth NMOS transistor having a gate coupled to the first output node and a drain coupled to a source of the fifth NMOS transistor.

18. The time amplifier circuit of claim 16 wherein:

the first pull-down path comprises:

a third NMOS transistor having a gate coupled to the second output node and a drain coupled to the first output node, and a fourth NMOS transistor having a gate coupled to the first input node and a drain coupled to a source of the third NMOS transistor; and the second pull-down path comprises:

a fifth NMOS transistor having a gate coupled to the first output node and a drain coupled to the second output node, and a sixth NMOS transistor having a gate coupled to the second input node and a drain coupled to a source of the fifth NMOS transistor.

19. The time amplifier circuit of claim 16, wherein the time amplifier circuit comprises exactly eight transistors.

20. A time amplifier circuit comprising:

a first inverter comprising a first NMOS transistor and a first PMOS transistor, respective gates of the first NMOS and PMOS transistors coupled together to a first input node for receiving a first input signal, respective drains of the first NMOS and PMOS transistors coupled together to provide a first output signal at a first output node, a source of the first PMOS transistor coupled directly to a power supply node;

a second inverter comprising a second NMOS transistor and a second PMOS transistor, respective gates of the second NMOS transistor and the second PMOS transistor coupled together to a second input node for receiving a second input signal, respective drains of the second NMOS transistor and the second PMOS transistor coupled together to provide a second output signal at a second output node, a source of the second PMOS transistor coupled directly to the power supply node;

a first pull-up path, from the first output node to the power supply node, enabled in response to the first input signal and the second output signal being low; and a second pull-up path, from the second output node to the power supply node, enabled in response to the second input signal and the first output signal being low;

wherein the voltage at the first input node is independent of the voltage at the second input node.

21. The time amplifier circuit of claim 20 wherein:

the first pull-up path comprises:

a third PMOS transistor having a gate coupled to the first input node and a drain coupled to the first output node, and a fourth PMOS transistor having a gate coupled to the second output node and a drain coupled to a source of the third PMOS transistor; and the second pull-up path comprises:

a fifth PMOS transistor having a gate coupled to the second input node and a drain coupled to the second output node, and a sixth PMOS transistor having a gate coupled to the first output node and a drain coupled to a source of the fifth PMOS transistor.

22. The time amplifier circuit of claim 20 wherein:

the first pull-up path comprises:

a third PMOS transistor having a gate coupled to the second output node and a drain coupled to the first output node, and a fourth PMOS transistor having a gate coupled to the first input node and a drain coupled to a source of the third PMOS transistor; and the second pull-up path comprises:

a fifth PMOS transistor having a gate coupled to the first output node and a drain coupled to the second output node, and a sixth PMOS transistor having a gate coupled to the second input node and a drain coupled to a source of the fifth PMOS transistor.

23. The time amplifier circuit of claim 20, wherein the time amplifier circuit comprises exactly eight transistors.

24. A method of amplifying a time difference between rising edges of two signals, the method comprising:

receiving a first input signal and a second input signal;

inverting the first signal to provide a first output signal at a first output node;

inverting the second input signal to provide a second output signal at a second output node;

providing a first independent pull-down path from the first output node to a ground node through exactly one NMOS transistor, wherein the first independent pull-down path is provided independent of a voltage at the second output node;

providing a second independent pull-down path from the second output node to the ground node through exactly one NMOS transistor, wherein the second independent pull-down path is provided independent of a voltage at the first output node;

enabling a first dependent pull-down path from the first output node to the ground node in response to a first condition being met, wherein the first dependent pull-down path is dependent on a signal at the second output node and the first dependent pull-down path includes an NMOS transistor having a gate driven by the first input signal; and enabling a second dependent pull-down path from the second output node to the ground node in response to a second condition being met, wherein the second dependent pull-down path is dependent on a signal at the first output node and the second dependent pull-down path includes an NMOS transistor having a gate driven by the second input signal.

* * * * *